US009593287B2

(12) United States Patent
Dalai et al.

(10) Patent No.: US 9,593,287 B2
(45) Date of Patent: Mar. 14, 2017

(54) PROCESS FOR PRODUCING A LUBRICANT FROM AN EPOXY-TRIGLYCERIDE

(71) Applicant: University of Saskatchewan, Saskatoon (CA)

(72) Inventors: Ajay Kumar Dalai, Saskatoon (CA); Rajesh Vishnudev Sharma, Maharashtra (IN)

(73) Assignee: University of Saskatchewan, Saskatoon, Saskatchewan (CA)

( * ) Notice: Subject to any disclaimer, the term of this patent is extended or adjusted under 35 U.S.C. 154(b) by 0 days.

(21) Appl. No.: 14/729,128

(22) Filed: Jun. 3, 2015

(65) Prior Publication Data

US 2015/0353857 A1 Dec. 10, 2015

Related U.S. Application Data

(60) Provisional application No. 62/009,530, filed on Jun. 9, 2014.

(30) Foreign Application Priority Data

Jun. 9, 2014 (CA) ..... 2853848

(51) Int. Cl.

| | |
|---|---|
| ***C10M 105/32*** | (2006.01) |
| ***C10M 121/04*** | (2006.01) |
| ***C10M 129/68*** | (2006.01) |
| ***C11C 3/00*** | (2006.01) |
| ***C11C 1/06*** | (2006.01) |
| ***C10M 105/36*** | (2006.01) |
| ***C10M 177/00*** | (2006.01) |
| ***C10M 105/42*** | (2006.01) |
| ***C11C 3/08*** | (2006.01) |

(52) U.S. Cl.

CPC ..... *C10M 105/36* (2013.01); *C10M 105/42* (2013.01); *C10M 177/00* (2013.01); *C11C 3/08* (2013.01)

(58) Field of Classification Search

CPC ..... C11C 3/00; C07C 67/24; C07C 67/08; C10M 104/36; C10M 104/452; C10M 177/00; C10M 7067/24; C10M 104/08

See application file for complete search history.

(56) References Cited

U.S. PATENT DOCUMENTS 8,357,643 B2 * 1/2013 Benecke ..... C10M 129/74 508/496

FOREIGN PATENT DOCUMENTS

CN 103113993 A * 5/2013

OTHER PUBLICATIONS

Green approach for the preparation of biodegradable lubricant bast stock from epoxidized vegetable oil by Piyush S. Lathi and Bo Mattiasson avaialbone online Aug. 4, 2006 Applied Catalysis B Environmental 69 (2007) 207-212.*

(Continued)

*Primary Examiner* — Pamela H Weiss
(74) *Attorney, Agent, or Firm* — Bereskin & Parr LLP/S.E.N.C.R.L., s.r.l.; Patricia Folkins

(57) ABSTRACT

A process for producing a lubricant from an epoxy-triglyceride comprising treating the epoxy-triglyceride with an esterifying agent in the presence of a heterogeneous catalyst under conditions to produce the lubricant is disclosed.

17 Claims, 14 Drawing Sheets

(56) References Cited

OTHER PUBLICATIONS

Sharma, Rajesh V., et al,. "Synthesis of bio-lubricant from epoxy canola oil using suflated Ti-SBA-15 catalyst", Applied Catalysis B: Environmental, 142-143, 2013, 604-614.
Madankar, Chandu S., et al,. "Green synthesis of biolubricant base stock from canola oil", Industrial Crops and Products 44, 2013, 139-144.
Sharma, Rajesh V., et al, "Preparation, characterization and application of sulfated Ti-SBA-15 catalyst for oxidation of benzyl alcohol to benzaldehyde",Catalysis Communications, 29, 2012, 87-91.

* cited by examiner

Fig. 4a. Plot of initial reaction rate vs catalyst loading

PROCESS FOR PRODUCING A LUBRICANT FROM AN EPOXY-TRIGLYCERIDE

CROSS-REFERENCE TO RELATED APPLICATIONS

The present application claims the benefit of priority from U.S. provisional application No. 62/009,530 filed on Jun. 9, 2014, the contents of which are incorporated herein by reference in their entirety.

FIELD OF THE APPLICATION

The present application is in the field of esterification of epoxy-triglycerides, in particular for the production of lubricants.

BACKGROUND OF THE APPLICATION

Lubricants are extensively utilized in industry and in the automobile sectors for lubricating machineries and materials. A wide range of lubricant base oils is available in the market, which are derived from mineral oil, synthetic oil, refined oil, and vegetable oil. Among them, lubricants derived from mineral oil are most commonly used although they are non-biodegradable and toxic in nature [1]. Extensive use of petroleum based lubricants is creating several environmental issues, such as surface water and ground water contamination, air pollution, soil contamination, and agricultural product and food contamination [2]. Public awareness has resulted in strict government regulations for petroleum based lubricants and hence, new technologies have been aimed at developing lubricant base oils from renewable sources. Synthetic lubricants, solid lubricants and vegetable oil based lubricants are the alternatives to petroleum based lubricants, and they are currently being explored by the scientists and tribologists [3].

Vegetable oil based lubricants are a highly attractive substitute to petroleum based lubricants because these can be environmentally friendly, renewable, non-toxic and completely biodegradable. Vegetable oil based lubricants are preferred not only because of renewability, but also because of their excellent lubricating properties such as high viscosity index (i.e., minimum changes in viscosity with temperature), high flash-point, low volatility, good contact lubricity, and good solvent properties for fluid additives [4]. However, vegetable oil based lubricants have some drawbacks such as poor low temperature properties (opacity, precipitation, poor flow ability and/or solidification at relatively moderate temperature), and poor oxidative and thermal stability (due to the presence of unsaturation) [5]. However, the low temperature properties of vegetable oil based lubricants can be attenuated with the use of additives [4,6]. The oxidative stability of vegetable oil based lubricants can be improved by selective hydrogenation of polyunsaturated C=C bonds of triglycerides [7], or conversion of C=C double bonds of triglycerides to oxirane rings via epoxidation [8-9]. A wide range of reactions can be carried out under moderate reaction conditions by modification of C=C double bonds of triglycerides to oxirane rings [10] and hence, this has received more attention as compared to hydrogenation of C=C double bonds.

Obtaining lubricants from vegetable oils involves three steps: (i) epoxidation of triglycerides to produce epoxy-triglycerides, (ii) ring opening of epoxy-triglycerides, and (iii) esterification. Epoxidized triglycerides are produced industrially by an in situ epoxidation process, in which acetic or formic acid reacts with hydrogen peroxide in the presence of a mineral acid such as sulfuric or phosphoric acid [11]. However, use of a strong mineral acid leads to many side reactions, such as oxirane ring opening to diol, hydroxyesters, dimer formation, and also hydrolysis of oil. Enzymes, resins and heterogeneous catalysts are being used for the epoxidation of oil to overcome the problems connected with the use of mineral acids [12-14].

Goud et al. (2006) reported epoxidation of Mahua oil (Madhumica indica) by using mineral acid (nitric acid and sulfuric acid) as catalyst, hydrogen peroxide as oxygen donor and acetic acid as an active oxygen carrier [15]. Dinda et al. (2008) studied the kinetics of epoxidation of cotton seed oil by peroxyacetic acid generated in situ from hydrogen peroxide and glacial acetic acid in the presence of a mineral acid [16]. Lu et al. (2010) reported the epoxidation of soyabean methyl ester by using Candida Antarctica lipase immobilized on polyacrylic resin in the presence of hydrogen peroxide and free fatty acid [17]. Olellana-Coca et al. (2007) synthesized alkylstearates by using immobilized lipase (Candida Antarctica lipase) followed by epoxidation of oleic acid [13]. Most enzymes were deactivated during epoxidation due to the presence of hydrogen peroxide. Tornvall et al. (2007) studied the stability of Candida Antarctica lipase B during the chemo-enzymatic epoxidation of fatty acids, and reported that temperature control and careful dosage of hydrogen peroxide is essential for chemo-enzymatic processes [18]. Meshram et al. (2011) used the acidic cation exchange resin Amberlite IR-122 for epoxidation of wild safflower oil by using hydrogen peroxide and acetic acid [19]. Mungroo et al. (2008) used Amberlite IR-120H resin for epoxidation of canola oil using hydrogen peroxide and acetic acid/formic acid, and concluded that acetic acid is a better oxygen carrier as compared to formic acid [20]. Sinadinovic-Fiser et al. (2001) studied the kinetics of epoxidation of soyabean oil in the presence of an ion exchange resin, and kinetic parameters were estimated by fitting experimental data using Marquardt method [8].

Limited literature is available on ring opening of epoxy-triglycerides of vegetable oils (also referred to herein as vegetable epoxy-triglycerides) to produce an esterified product. Hwang and Erhan (2001) studied a sulfuric acid catalyzed epoxy ring-opening reaction of epoxidized soybean oil with various linear and branched alcohols followed by esterifying the resulting hydroxyl group with an acid anhydride [6]. Adhvaryu et al. (2005) prepared dihydroxylated soyabean oil by using perchloric acid, and further esterified with acetic, butyric, hexanoic anhydride in the presence of an equimolar quantity of pyridine [1]. Salimon et al. (2010) reported three step processes: epoxidation of ricinoleic acid by using hydrogen peroxide and formic acid, followed by ring opening with various fatty acids by using p-toluenesulfonic acid, and finally esterification with 1-octanol using sulfuric acid [21].

SUMMARY OF THE APPLICATION

The present application discloses a process for esterification of epoxy-triglycerides using a heterogeneous catalyst to produce a lubricant.

The use of a heterogeneous catalyst means that the process of the present application may be considered generally green and sustainable, since the heterogeneous catalyst allows for ease of separation, catalyst reuse and environmental safety [22]. The heterogeneous catalyst is, in some examples, a sulfated Ti-SBA-15 catalyst.

In general, the process disclosed herein allows for lubricants to be obtained from epoxy-triglycerides in a one-step process that includes (i) epoxy ring opening, and (ii) esterification.

Accordingly, the present application includes a process for producing a lubricant from an epoxy-triglyceride, the process comprising:

a) treating the epoxy-triglyceride with an esterifying agent in the presence of a heterogeneous catalyst under conditions to produce the lubricant.

In some embodiments, the esterifying agent comprises a $C_1$ to $C_6$ alkyl anhydride. In other embodiments, the esterifying agent includes acetic anhydride. In other embodiments, the esterifying agent includes a carboxylic acid. In other embodiments, the esterifying agent includes a carboxylic acid selected from the group consisting of acetic acid, succinic acid, maleic acid, and glutaric acid. In another embodiment, the esterifying agent, for example, acetic anhydride, is used in an amount that is approximately from 1.5 wt % to 4 wt % of the epoxy triglyceride.

In some embodiments, the heterogeneous catalyst comprises a silica catalyst. In other embodiments, the silica catalyst is a mesoporous silica catalyst.

In some embodiments, the heterogeneous catalyst is a titanium substituted silica catalyst. In other embodiments, the titanium-substituted silica catalyst has a Si/Ti ratio of at most about 80. In some embodiments, the Si/Ti ratio is about 10.

In some embodiments, the heterogeneous catalyst comprises a sulfated titanium-substituted silica catalyst. In other embodiments, the heterogeneous catalyst comprises sulfated Ti-SBA-15. In further embodiments, the sulfated Ti-SBA-15 has a Si/Ti ratio of about 10.

In some embodiments, the heterogeneous catalyst comprises at least one of amorphous $SiO_2$, SBA-15, Ti-SBA-15, sulfated Ti-SBA-15, Amberlyst-15, IRA-400, and IRA-200.

In some embodiments, about 5% to about 20% catalyst is used by weight with respect to a weight of the epoxy-triglyceride. In embodiments, about 10% catalyst is used by weight with respect to a weight of the epoxy-triglyceride.

In some embodiments, the process further comprises filtering a product of a) to recover the heterogeneous catalyst.

In some embodiments, the process comprises agitating the epoxy-triglyceride, esterifying agent, and heterogeneous catalyst at a speed of at least about 600 rpm, or of at least about 1000 rpm.

In some embodiments, a) is carried out at a reaction temperature of about 100 degrees Celsius to about 140 degrees Celsius. In further embodiments, a) is carried out at a reaction temperature of about 128 degrees Celsius to about 132 degrees Celsius.

The present application further includes a catalyst for use in producing a lubricant from an epoxy triglyceride. In an embodiment, the catalyst comprises a sulfated titanium-substituted silica.

In embodiments of the application the catalyst is mesoporous. In further embodiments, the catalyst has an Si/Ti ratio of less than about 80, for example an Si/Ti ratio of about 10.

Other features and advantages of the present application will become apparent from the following detailed description. It should be understood, however, that the scope of the claims should not be limited by the embodiments set forth in the examples, but should be given the broadest interpretation consistent with the description as a whole.

BRIEF DESCRIPTION OF THE DRAWINGS

The present application includes references to appended drawings in which.

DETAILED DESCRIPTION OF THE APPLICATION

I. Definitions

Figure 1:
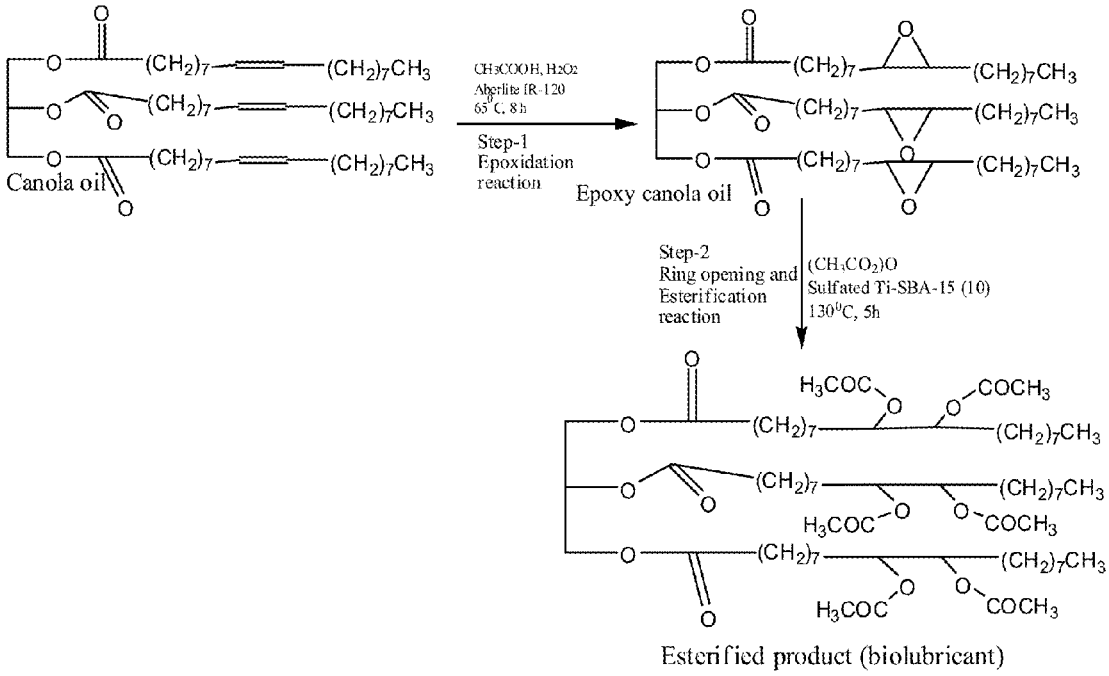
FIG. 1 is a schematic diagram showing an embodiment of a reaction scheme for the preparation of esterified canola oil from canola oil.

Unless otherwise indicated, the definitions and embodiments described in this and other sections are intended to be applicable to all embodiments and aspects of the application herein described for which they are suitable as would be understood by a person skilled in the art.

As used in this application, the singular forms "a", "an" and "the" include plural references unless the content clearly dictates otherwise. For example, an embodiment including "an esterifying agent" should be understood to present certain aspects with one esterifying agent, or two or more additional esterifying agents.

In embodiments comprising an "additional" or "second" component, such as an additional or second "esterifying agent", the second component as used herein is chemically different from the other components or first component. A "third" component is different from the other, first, and second components, and further enumerated or "additional" components are similarly different.

The term "suitable" as used herein means that the selection of the particular compound or conditions would depend on the specific synthetic manipulation to be performed, and the identity of the molecule(s) to be transformed, but the selection would be well within the skill of a person trained in the art. All process/method steps described herein are to be conducted under conditions sufficient to produce the product shown. A person skilled in the art would understand that all reaction conditions, including, for example, reaction solvent, reaction time, reaction temperature, reaction pressure, reactant ratio and whether or not the reaction should be performed under an anhydrous or inert atmosphere, can be varied to optimize the yield of the desired product and it is within their skill to do so.

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. The term "consisting" and its derivatives, as used herein, are intended to be closed terms that specify the presence of the stated features, elements, components, groups, integers, and/or steps, but exclude the presence of other unstated features, elements, components, groups, integers and/or steps. The term "consisting essentially of", as used herein, is intended to specify the presence of the stated features, elements, components, groups, integers, and/or steps as well as those that do not materially affect the basic and novel characteristic(s) of features, elements, components, groups, integers, and/or steps. For example, when a catalyst "consists essentially of" the stated elements, then only the stated elements are present for the purpose of catalysis, however the catalyst may include other elements that do not materially affect the basic function of the catalytic elements, and/or that do not function as part of the catalytic process.

Terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

The term "heterogeneous catalyst" as used herein refers to catalyst that is in a different form from that of the reactants. In embodiments of the present application, the heterogeneous catalyst is a solid, where the reactants are liquids or in a solution.

The term "lubricant" as used herein refers to a substance that is used to reduce friction between moving surfaces, for example to protect against wear or corrosion. Such surfaces include, for example, surfaces of industrial machinery, or surfaces of automobiles. In an embodiment, the term "lubricant" refers to a single compound usable to reduce friction between moving surfaces, such as a base oil. In an alternative embodiment, the term "lubricant" refers to a mixture of substances, such as a mixture containing a base oil and various additives. Lubricants of the present application include, for example, esterified vegetable oils. In use, the esterified vegetable oils are used alone as a lubricant, or are combined with various additives to form a lubricant.

As used herein, the term "vegetable oil" refers to a triglyceride obtained from a vegetable. Accordingly, for example, the term "canola oil" refers to a triglyceride obtained from canola.

The term "epoxy-triglyceride" as used herein refers to a triglyceride in which at least one C═C double bond of at least one fatty acid chain has been converted to an oxirane ring via epoxidation.

The term "esterified triglyceride" as used herein refers to a triglyceride in which at least one C═C double bond of at least one fatty acid chain has been converted to a single bond, and at least one carbon that was formerly part of the C═C double bond is substituted with an ester.

The term "esterifying agent" as used herein refers to any chemical compound that when combined with an epoxy-triglyceride under suitable conditions will react with the epoxy-triglyceride to yield an esterified triglyceride.

The term "mesoporous" as used herein refers to a material containing pores having a pore diameter of between approximately 2 nm and approximately 50 nm.

The term "silica" as used herein refers to a compound of the formula $SiO_2$, and is interchangeable with the term "silicon dioxide". Accordingly, the term "silica catalyst" as used herein refers to a catalyst comprising, consisting of, or consisting essentially of $SiO_2$.

The term "titanium-substituted silica" as used herein refers to silica in which at least some of the silicon has been substituted with titanium, yielding moieties of the formula Si—O—Ti. Accordingly, the term "titanium-substituted silica catalyst" as used herein refers to a catalyst comprising, consisting of, or consisting essentially of moieties of the formula Si—O—Ti.

The term "sulfated" as used herein refers to a compound that includes a moiety of the formula $SO_4^{2-}$. Accordingly, the term "sulfated titanium-substituted silica catalyst" as used herein refers to a catalyst comprising, consisting of, or consisting essentially of moieties of the formula Si—O—Ti and moieties of the formula $SO_4^{2-}$. A person skilled in the art would appreciate that the sulfate moiety is an anion and will require two ionic or covalent bonds in the solid state to counter the negative charge. Anionic species typically exist in aqueous solutions in dissociated form.

The term "SBA-15" as used herein refers to a silica catalyst having a pore diameter of about 4.6 nanometers to about 30 nanometers, and having a hexagonal array of pores.

II. Processes of the Application

Figure 2:
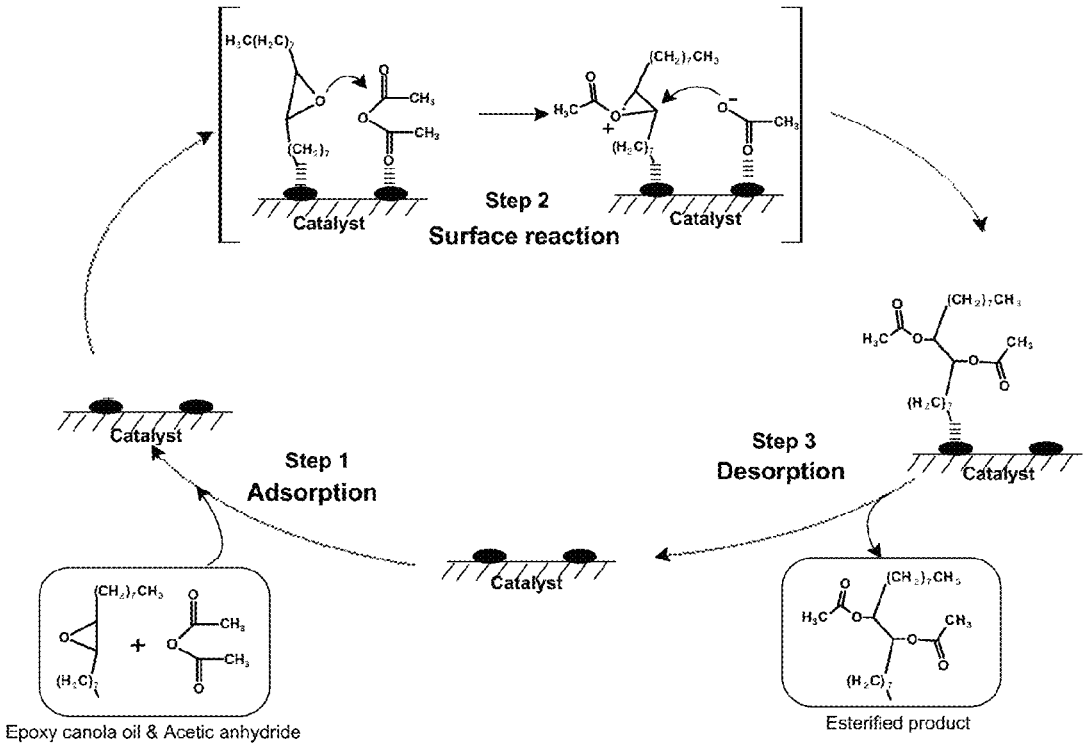
FIG. 2 is a schematic diagram showing a proposed reaction mechanism for the esterification of epoxy canola oil in one embodiment of the application.

The present application includes a process for producing a lubricant from an epoxy-triglyceride. The lubricant comprises, consists of, or consists essentially of an esterified triglyceride. The lubricant is produced by treating the epoxy-triglyceride with an esterifying agent in the presence of a heterogeneous catalyst, under conditions to produce the lubricant, for example, as shown in FIGS. 1 and 2. The processes disclosed herein produce lubricants that are potentially renewable, biodegradable, and non-toxic, and also have sufficient lubricity and oxidative properties.

The epoxy-triglyceride in some embodiments is obtained via epoxidation of a vegetable oil. Suitable vegetable oils include, for example, canola oil, soybean oil, mahua oil, cotton seed oil, safflower oil, coconut oil, corn oil, olive oil, palm oil, peanut oil, sesame oil, sunflower oil, and mustard oil. In one specific embodiment, the epoxy-triglyceride is obtained via epoxidation of canola oil.

The vegetable oil is epoxidized in any suitable manner, including the methods described in the "Background of the Application" above. In one embodiment, the vegetable oil is canola oil, and is epoxidized via treatment with acetic acid and hydrogen peroxide in the presence of Amberlite IR-120 catalyst, for example, as shown in FIG. 1.

As noted above, the lubricant is produced by treating the epoxy-triglyceride with an esterifying agent in the presence of a heterogeneous catalyst. In some embodiments, the esterifying agent is a $C_1$ to $C_6$ alkyl anhydride, such as acetic anhydride, for example, as shown in FIGS. 1 and 2. In other embodiments, the esterifying agent is acetic acid. In yet other embodiments, the esterifying agent is maleic anhydride, succinic anhydride, glutaric anhydride, maleic acid, succinic acid, glutaric acid, or cyclic dicarboxylic acids or cyclic anhydrides. In yet further embodiments, the esterifying agent includes a mixture of two or more different esterifying agents.

The heterogeneous catalyst is, for example, in the form of a powder or a pellet.

In some embodiments, the heterogeneous catalyst is a silica catalyst. For example, the silica catalyst is amorphous $SiO_2$. In further embodiments, the silica catalyst is a mesoporous silica catalyst. In one particular embodiment, the heterogeneous catalyst is a mesoporous silica catalyst known as SBA-15.

In further embodiments, the heterogeneous catalyst is a titanium substituted silica catalyst. For example, the heterogeneous catalyst is a catalyst known as Ti-SBA-15. In some embodiments, the titanium substituted silica catalyst has a Si/Ti ratio of at most about 80. For example, the Si/Ti ratio is about 80, about 40, about 20, or about 10.

In further embodiments, the heterogeneous catalyst is a sulfated titanium substituted silica catalyst. In one particular example, the sulfated titanium substituted silica catalyst is sulfated Ti-SBA-15, having a Si/Ti ratio of about 10.

In other embodiments, the heterogeneous catalyst is any other suitable heterogeneous catalyst, such as Amberlyst-15, IRA-400, or IRA-200.

The catalyst is prepared using various methods. In one particular example, where the catalyst is a sulfated titanium substituted silica catalyst, the catalyst is prepared by sulfating Ti-SBA-15 with cholorosulfonic acid.

As stated above, the epoxy-triglyceride is treated under conditions to produce the lubricant. For example, the epoxy-triglyceride, esterifying agent, and heterogeneous catalyst are combined and maintained at a reaction temperature for a reaction time, with agitation, in order to produce the lubricant.

In some embodiments, the reaction temperature is about 100 degrees Celsius to about 140 degrees Celsius. In some particular embodiments, the reaction temperature is about 128 degrees Celsius and to about 132 degrees Celsius.

In some embodiments, the reaction time is approximately 5 hours.

In some embodiments, the epoxy-triglyceride, esterifying agent, and heterogeneous catalyst are agitated at a speed of at least about 600 rpm. For example, the epoxy-triglyceride, esterifying agent, and heterogeneous catalyst are agitated at speeds of about 600 rpm, about 800 rpm, about 1000 rpm, or about 1200 rpm. In some specific embodiments, the epoxy-triglyceride is agitated at a speed of at least about 1000 rpm.

The epoxy-triglyceride is treated with the esterifying agent at various weight ratios. In some embodiments, the esterifying agent, for example, acetic anhydride, is used in an amount that is approximately from 1.5 wt % to 4 wt % of the epoxy triglyceride, for example, an amount that is approximately 1.5 wt % of the epoxy triglyceride.

The catalyst is present at various weight ratios. For example, about 5% to about 20% catalyst is present by weight with respect to a weight of the epoxy-triglyceride. In one specific embodiment, about 10% catalyst is present by weight with respect to a weight of the epoxy-triglyceride.

In some embodiments, after treating the epoxy-triglyceride with the esterifying agent in the presence of the heterogeneous catalyst, the product of the reaction is filtered to recover the heterogeneous catalyst.

The processes of the application are performed in a batch or continuous format. Commercial processes are generally performed in a continuous format.

EXAMPLES

Experimental

Chemicals and Reagents

Canola oil was supplied by Loblaws Inc. (Montreal, Canada). The sources of other chemicals are as follows: glacial acetic acid (100%) from EMD Chemicals Inc. (Darmstadt, Germany), methylene chloride from Sigma-Aldrich (St. Louis, Mo., USA), chlorosulfonic acid from Sigma-Aldrich (St. Louis, Mo., USA), GR grade hydrogen peroxide (30 wt %) from EMD Chemicals Inc., Amberlite IR-120 from Sigma-Aldrich (St. Louis, Mo., USA), ethyl acetate from EMD Chemicals Inc, Wijs' solution were procured from VWR (San Diego, Calif., USA), 33% HBr in acetic acid, poly(ethylene glycol)-block-poly(propylene glycol)-block-poly(ethylene glycol), titanium isopropoxide, tetraethyl orthosilicate were obtained from EMD Chemicals Inc.

Catalyst Synthesis

Ti-SBA-15 with different Si/Ti ratios (10, 20, 40, 80) and sulfated Ti-SBA-15(10) were prepared according to the method reported by Sharma et al. (2012) [23]. The molar gel composition of the solution was TEOS (0.988): $Ti(O'Pr)_4$ (0.024-0.05): P123 (0.016): HCl (0.46): $H_2O$ (127). Ti-SBA-15 with Si/Ti=10 was synthesized by mixing pluronic P123 (9.28 g) in water (228.6 g). The solution was stirred for 2 h at 40° C. Thereafter, 4.54 g of HCl (37 wt %) was added to the solution and stirred for another 2 h. Then, a mixture of tetraethylorthosilicate (20.83 g) and titanium isopropoxide (2.84 g) was added drop wise, and then the solution was stirred for 24 h at 40° C. Hydrothermal treatment was done by keeping the solution at 100° C. for 24 h in Teflon bottle. The solid material was recovered by filtration, washed with water, and kept at 100° C. for 12 h. Finally, the material was calcined at 550° C. for 6 h. The samples were labeled as Ti-SBA-15(10), where 10 denotes Si/Ti ratio in the material. The same procedure was followed to prepare other materials having different Si/Ti ratios such as 20, 40 and 80 by varying the molar composition of tetraethylorthosilicate and titanium isopropoxide. Sulfation of Ti-SBA-15(10) was carried out using 0.5 M solution of chlorosulfonic acid (in methylene dichloride). Further, the catalyst was calcined at 550° C. for 3 h and denoted as sulfated Ti-SBA-15(10).

Epoxidation of Canola Oil

Epoxidation of canola oil was carried out in a three necked round bottom flask (500 mL capacity), equipped with an overhead stirrer and placed in an oil bath at a temperature of 65±2° C. The side neck of the flask was connected to a reflux condenser, and the thermometer was introduced through another side neck to record the temperature of the reaction mixture. Epoxidized canola oil was prepared by a method reported in the literature by Mungroo et al. (2008) [20]. A 22.6 g sample of canola oil was placed in the round bottom flask, a calculated amount of acetic acid (acid to ethylenic unsaturation molar ratio, 0.5:1), and Amberlite IR −120 catalyst (22 wt % of oil) were added, and the mixture was stirred continuously for 30 min. Then, 17 g of 30% aqueous $H_2O_2$ (hydrogen peroxide to ethylenic unsaturation molar ratio 1.5:1) was added. The reaction mixture was continuously stirred for 8 h. The complete conversion of canola oil was monitored by iodine value and oxygen content. Thereafter, the reaction mixture was filtered and extracted with ethyl acetate, washed with water to remove acetic acid, and then concentrated in rotary evaporator to obtain viscous oil. Epoxidized canola oil was confirmed by FT-IR, $^1$H NMR, and $^{13}$C NMR.

Ring Opening and Esterification of Epoxidized Canola Oil

Ring opening and esterification reactions were carried out simultaneously in a three necked round bottom flask (100 mL capacity), equipped with a magnetic stirrer and placed in an oil bath. The center neck of the flask was connected to a reflux condenser, and a thermometer was introduced through one of the side necks of flask to record the temperature of the reaction mixture, and the oil bath was maintained at the desired temperature of 130±2° C. Typically, 3.0 g of epoxidized canola oil, 4.5 g of acetic anhydride and 10 wt % of catalyst with respect to epoxy canola oil were placed in the flask and the mixture was continuously stirred for 5 h at 130° C. A zero time sample was withdrawn before the addition of catalyst and the course of the reaction was monitored by withdrawing the samples at regular intervals. The samples were filtered to remove the catalyst and the solution was analyzed for oxirane content.

Method of Analysis

The iodine value was determined using Wijs solution according to the method reported in AOCS Cd 1-25. The oxirane oxygen content of each sample was determined by using the standard AOCS Cd 9-57 method. In this method, samples were titrated with 0.1 N HBr solution (in acetic acid) using crystal violet as an indicator. All experiments were repeated thrice and have ±3% of error. The product was confirmed by FTIR, $^1$H NMR and $^{13}$C NMR. Oxirane oxygen content and percentage conversion was calculated as follows:

$$\text{Oxirane oxygen content} = \frac{\text{mL of } HBr \text{ solution required to titrate sample} \times N \times 1.60}{\text{mass of sample (g)}} \quad (1)$$

where, $N$ is the normality of the $HBr$ solution.

$$\text{Conversion}(\%) = \frac{\text{Oxirane content at time}(t_0) - \text{Oxirane content at time}(t_t)}{(\text{Oxirane content at time}(t_0)} \times 100 \quad (2)$$

Tribological Property of Esterified Product (Bio-Lubricant)

The viscosity of the esterified canola oil was measured at 100° C. The measurements were carried out using a DV-II+ Pro Viscometer (Brookfield, USA), equipped with a constant temperature bath. Kinematic viscosity was measured as the method mentioned with ASTM standard D445-12. The viscosity measurement was made in duplicate to eliminate error and the average of the two values was reported. Cloud point and pour point temperature was determined in accordance with ASTM standard methods, D2500-11 and D97-11 respectively, using a K46100 Cloud Point & Pour Point Apparatus (Koehler Instrument Company, Inc., USA). Oxidative stability was determined in accordance with AOCS Cd 12b-92 standard method, using Metrohm 743 Rancimat® (Metrohm, Canada) equipment at a standard temperature of 110° C. under a continuous flow of air at 15 L/h. The time at which a steady increase in the conductivity value of the conductivity cell was recorded, was denoted as oxidative induction time (OIT). Lubricity testing was carried out using High Frequency Reciprocating Rig (HFRR) apparatus, according to ASTM D6079-04 method. A 0.2 mL volume of canola oil derived lubricant was added to 1.8 mL of pure diesel fuel. The test sample was placed on sample container which has a smooth metal surface. The ball was placed in contact with the metal surface at 50 Hz for 75 minutes, and the wear scar diameter on the ball surface was then measured using a microscope.

Results and Discussion

Catalyst Characterization

Figure 3:
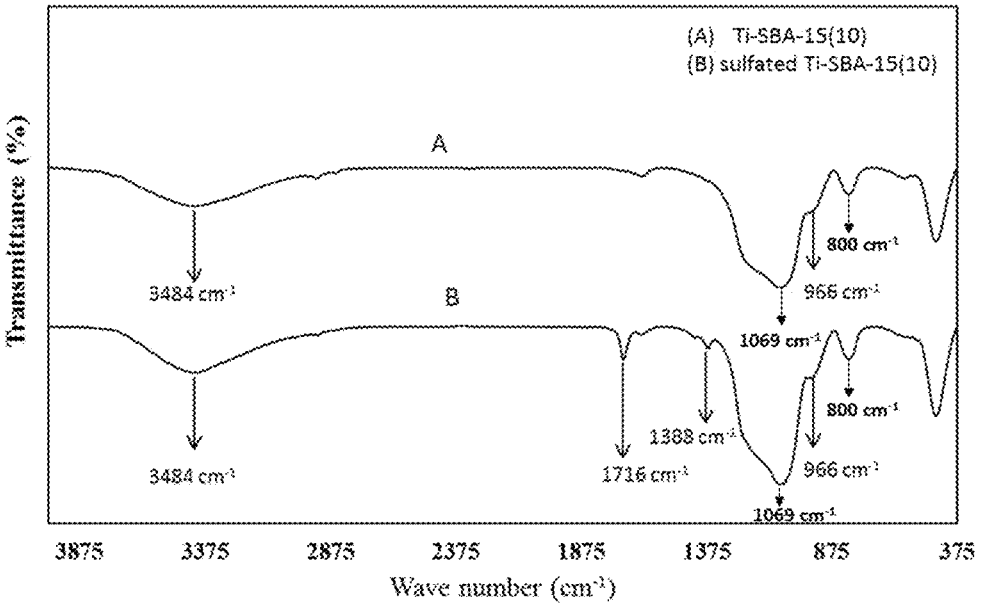
FIG. 3 shows the FTIR (Fourier Transform Infrared Spectroscopy) spectra of Ti-SBA-15(10) and sulfated Ti-SBA-15(10)
Figure 4:
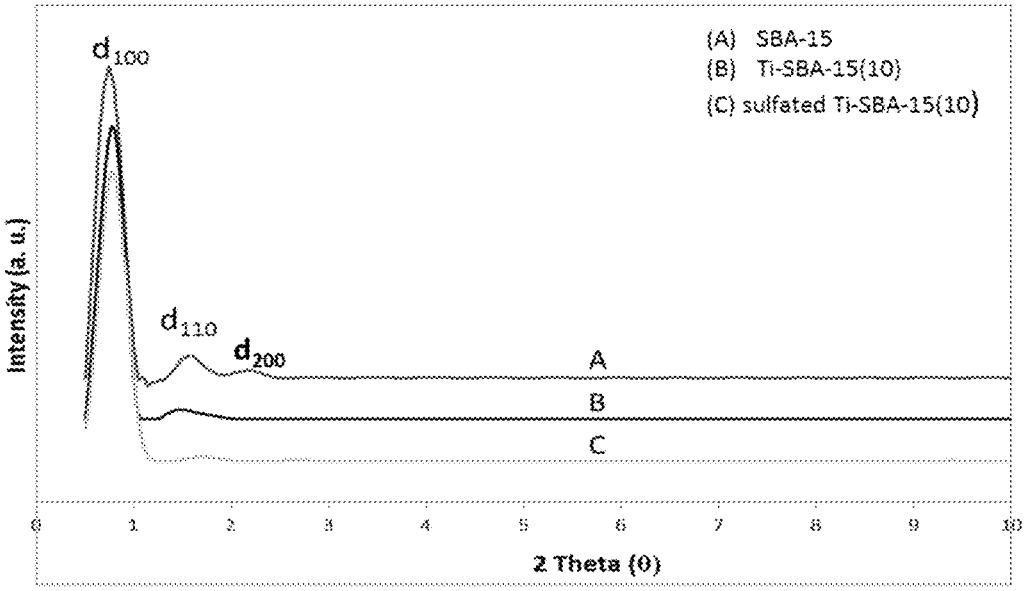
FIG. 4 shows the XRD (X-Ray Diffraction) patterns of SBA-15, Ti-SBA-15(10) and sulfated Ti-SBA-15(10)

The sulfated Ti-SBA-15(10) catalyst was characterized by FT-IR, X-ray diffraction analysis (XRD), $N_2$ adsorption-desorption isotherms (specific surface area, mean pore diameter and pore volume), $NH_3$-temperature programmed desorption analysis ($NH_3$-TPD) and energy dispersive X-ray analysis (EDX elemental analysis), and reported previously from laboratory by Sharma, et al. (2012) [23]. A few silent features are reported herein. FT-IR spectra of Ti-SBA-15 (10) and sulfated Ti-SBA-15(10) show the band at 966 cm$^{-1}$ is due to Si—O—Ti vibration (FIG. 3). Ti-SBA-15(10) catalyst absorbs the water molecules after treatment with chlorosulfonic acid, and hence the band at 1716 cm$^{-1}$ is due to vibration of adsorbed water molecule present in sulfated Ti-SBA-15(10) catalyst [24-25]. The band at 1388 cm$^{-1}$ in sulfated Ti-SBA-15(10) catalyst is attributed to sulfate group vibration. The band at 800, 1069 and 1228 cm$^{-1}$ show Si-0 bonding present in Ti-SBA-15(10) and sulfated Ti-SBA-15 (10) catalysts which agrees with the literature [26-27]. Table 1 represents the BET surface area, pore volume, pore diameter and EDX elemental analysis of Ti-SBA-15 with Si/Ti ratio from 10-80, and sulfated Ti-SBA-15(10). The data has an error of ±2% which confirmed from duplicate analysis. It is observed that chlorosulfonic acid treatment on Ti-SBA-15(10) decreased the specific surface area from 993 to 594 m$^2$/g. It can be due to the formation of sulfate linkage in sulfated Ti-SBA-15(10) catalyst which is also confirmed by FT-IR spectra by the band at 1388 cm$^{-1}$ due to sulfate group vibration. The specific surface area, mean pore volume and pore diameter of sulfated Ti-SBA-15(10) catalyst were found to be 594 m$^2$/g, 0.99 cm$^3$/g and 6.6 nm, respectively. The EDX data of sulfated Ti-SBA-15(10) catalyst demonstrate that 2.1 wt % of sulfur is present in the catalyst. The XRD patterns of SBA-15, Ti-SBA-15(10) and sulfated Ti-SBA-15(10) are represented in FIG. 4. The sharp peaks at around 20=0.80 and weak peaks at 20=1.6 and 2.07 are present in all three catalysts which indicate high structure periodicity due to better condensation between silanol and titanium centers [28]. These peaks can be indexed to the 100, 110 and 200 reflections which are characteristic of long range 2D hexagonal order of p6mm symmetry structure, which is in accordance with the literature report [29-30]. Therefore, it can be concluded that sulfation of Ti-SBA-15 (10) does not affect the hexagonal symmetry of Ti-SBA-15 (10). The wide angle XRD pattern i.e. from 20=0.5-90 (Figure is not shown) has no diffraction peak beyond 20=3 in Ti-SBA-15(10) and sulfated Ti-SBA-15(10) which represents the amorphous nature of the pore wall and absence of any extra-framework $TiO_2$ phase in both the catalysts which is inconsistent with the literature report [28]. The acidic strength of Ti-SBA-15(10) and sulfated Ti-SBA-15

Figure 5:
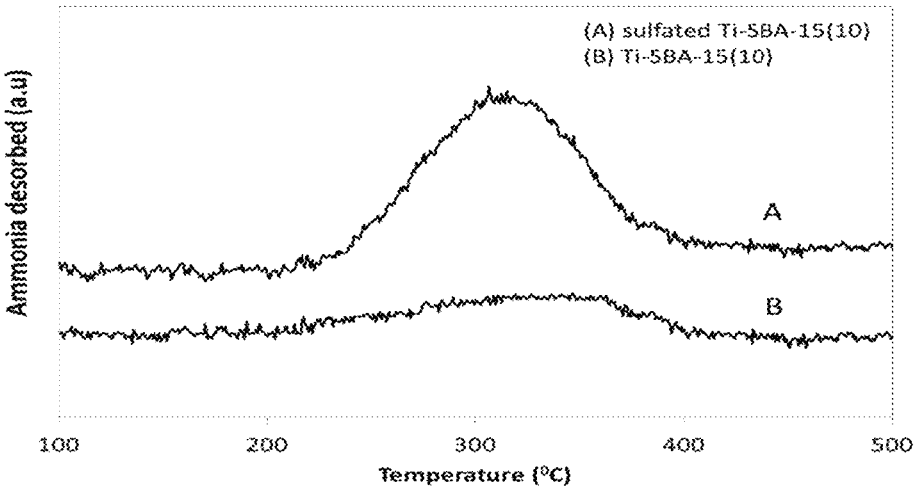
FIG. 5 is shows the $NH_3$-TPD profile of Ti-SBA-15(10) and sulfated Ti-SBA-15(10)

(10) were studied by using $NH_3$-TPD analysis (FIG. 5). Sulfated Ti-SBA-15(10) shows one broad peak at 220-390° C. in the strong acid strength range. This high temperature desorption of ammonia is due to the presence of strong acidic sites in the catalyst which is generated by the presence of sulfate linkage in the catalyst and confirmed by FT-IR and EDX data.

Screening of Catalysts

Amorphous $SiO_2$, SBA-15, Ti-SBA-15 with different Si/Ti ratios (10, 20, 40 and 80), sulfated Ti-SBA-15(10) and commercial catalysts such as Amberlyst-15, IRA-200, IRA-400 are evaluated for ring opening of epoxy canola oil to obtain the esterified triglyceride (Table 2). The reproducibility of all experimental data was confirmed by performing the reaction in triplicate with an error of ±3%. It was reported that with the increase in titanium content in the silica framework increase the acidity of the catalyst [23]. It is found that the percentage conversion increased with increase in titanium content in the catalyst. The sulfated Ti-SBA-15(10) shows the maximum conversion, which is due the presence of a strong acidic center in the catalyst. This strong acidity was confirmed by the $NH_3$-TPD profile. Therefore, from above characterization results, it can be concluded that large surface area, mesoporosity and high acidity of sulfated Ti-SBA-15(10) can be responsible for high catalytic activity for ring opening reaction of epoxy canola oil to esterified canola oil as compared to other commercial catalysts such as Amberlyst-15, IRA-200 and IRA-400. The complete conversion of epoxy ring opening to esterified product is a characteristic of the ideal bio-lubricant [14], as the unconverted epoxy linkage forms free hydroxyl groups in the lubricant during fuel combustion inside an engine, and leads to self-polymerization which results into engine coking Nevertheless, this application is not limited to the complete conversion to the esterified product. The sulfated Ti-SBA-15(10) resulted in complete conversion of epoxy canola oil, and hence was used for further reaction optimization.

Effects of Speed of Agitation, External Mass Transfer Resistance, and Intra Particle Diffusion Resistance In any industrial process, the overall rate of the reaction is generally limited by the rate of mass transfer of reactants between the bulk liquid phase and the catalytic surface. Lubricants are long chain high molecular weight compounds; therefore, the effective conversion of an epoxy-triglyceride to an esterified triglyceride is much influenced by mass transfer resistance. The liquid surrounding the catalyst particle forms an inter-phase between catalyst surface and liquid phase which causes resistance which is known as external mass transfer resistance. The flow of substrates into the pore to reach the active site of the catalyst is known as internal mass transfer resistance [32]. The sulfated Ti-SBA-15(10) catalyst generally has uniform mesopores and high surface area, which is confirmed by surface area measurement and XRD analysis, hence can act as a suitable catalyst for such bulky molecular transformation by decreasing both the external and internal mass transfer resistance. The external mass transfer resistance was investigated by carrying out the reaction at 600, 800, 1000 and 1200 rpm. The conversion of epoxy canola oil was found to be 100% at 1000 rpm (Table 3), and beyond 1000 rpm conversion remained constant, indicating that there was no external mass transfer resistance on the overall rate of reaction. Theoretical calculations (shown below) also confirmed the absence of external mass transfer resistance. Thus, the speed of agitation was kept at 1000 rpm for further experiments for the assessment of the effect of other variable parameters on the reaction.

The Wilke-Change equation and Sherwood number were used to calculate internal mass transfer resistance. The internal mass transfer resistance was calculated from the mass transfer coefficient for the reactants, which were obtained from their bulk liquid phase diffusivities. The diffusivity of the limiting reactant (epoxy canola oil) was calculated from the Wilke—Change equation given by $D_{ECO}=117.3\times10^{-18}\times(\psi\times M_{AA})^{0.5}\times T/(\mu\times V_{ECO}^{0.6})$, where $\psi=1$ (the association factor for acetic anhydride); $M_{AA}$ is molecular weight of acetic anhydride; T, reaction temperature in K; $\mu$ is the viscosity of reaction mixture; and $V_{ECO}$ is the molar volume of epoxy canola oil [31]. The value of $D_{ECO}$ calculated to be $8.66\times10^{-14}$ $m^2/s$. The value of mass transfer co-efficient for epoxy canola oil $kc_{ECO}$ was calculated from Sherwood number $Sh=kc_{ECO}\times D_p/D_{ECO}$ and the value was found to be $1.73\times10^{-8}$ m/s. The Sherwood number was taken to be 2 by assuming the extreme case [31]. The mass transfer flux of epoxy canola oil is given by $W_{ECOr}=kc_{ECO}\times C_{ECOs}$ and the value obtained was $1.10\times10^{-7}$ $mol/m^2$ s. The initial reaction rate was calculated from standard reaction and found to be $3.26\times10^{-8}$ $mol/m^2$ s. It confirms that the mass transfer rates were higher than the overall rates of reaction and hence speed of agitation had no influence on reaction rate beyond 1000 rpm. It also ensured that there was no internal mass transfer resistance during the reaction, and all data collected can be used for intrinsic kinetic study.

The influence of intra-particle diffusion resistance was evaluated using Weisz-Prater criterion [32]. The dimensionless parameter $\{C_{WP}=r_{obs}\times R_p^2/De_{ECO}[C_{ECOS}]\}$ represents the ratio of the intrinsic reaction rate to the intra-particle diffusion rate, can be evaluated from the observed reaction rate, the particle radius ($R_p$), effective diffusivity of the epoxy canola oil ($D_{eECO}$) and concentration of the reactant at the external surface particle [$C_{ECOS}$]. The effective diffusivity of epoxy canola oil ($D_{eECOS}$) inside the pores of the catalyst was calculated to be $9.18\times10^{-16}$ $m^2/s$ from bulk diffusivity $D_{ECO}$, porosity (0) and tortuosity ($\tau$). The average values of porosity and tortuosity were taken as 0.4 and 3, respectively. In the present case, the highest value of $C_{WP}$ was calculated as 0.45, which is less than 1. Hence, intra particle mass transfer resistance is absent for this reaction [32]. Hence, we can conclude that 1000 rpm is sufficient for complete conversion of the epoxy product to esterified product, which is desired for an ideal bio-lubricant.

Effect of Acetic Anhydride

Figure 6:
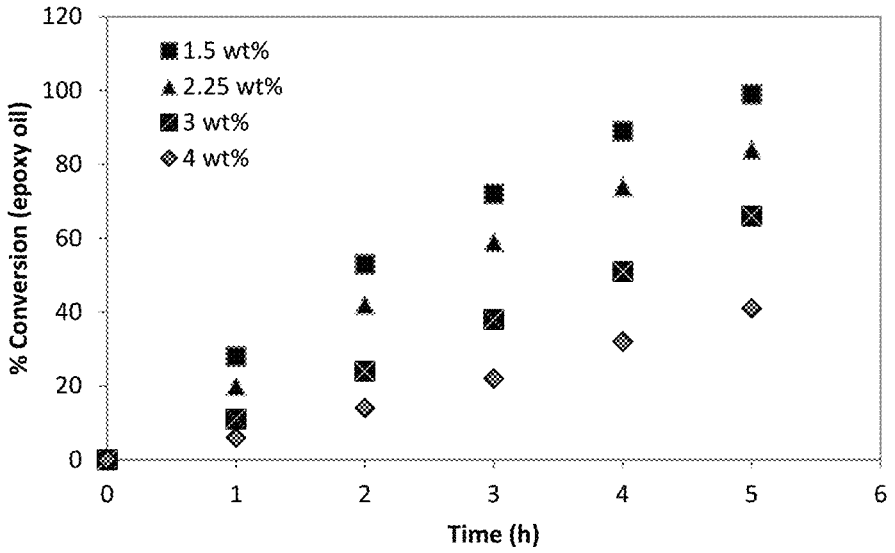
FIG. 6 is a graph showing the effect of acetic anhydride concentration on the conversion of epoxy canola oil to esterified canola oil in exemplary embodiments of the application.

The ring opening of epoxy canola oil to produce esterified canola oil was carried out by acetic anhydride. It was mentioned in the literature that esterification with acetic anhydride leads to high quality lubricant [1,6]. Acetic anhydride produces di-acetylated product while acetic acid resulted into the mono acetylated product. Hence, acetic anhydride was selected in the present study. Martini et al. (2009) used different cyclic dicarboxylic anhydride for ring opening reaction [33]. Lathi et al. (2006) used acetic anhydride for esterification reaction, and reported that the prepared bio-lubricant has better lubricating property [14]. In this study, the amount (wt) of acetic anhydride was increased in the reaction from 1.5 to 4 wt % of the epoxy canola oil (FIG. 6). It was found that with an increase in the amount of acetic anhydride, the conversion to esterified triglyceride decreased, which resulted in a lubricant with more epoxy linkages. This decrease can be due to adsorption of acetic anhydride on the catalyst's active sites, which is an agreement with the literature reported by Dejaegere et al. (2011) [34]. It is reported that the presence of two acyl groups on acetic anhydride increases the driving force for adsorption of acetic anhydride on the catalyst. It was also observed that with acetic anhydride at less than 1.5 wt % of epoxy canola oil, the reaction becomes viscous in nature, and it was difficult to separate the catalyst from the reaction. Therefore, further reaction optimization was carried out by using acetic anhydride at 1.5 wt % of the canola oil to obtain lubricant, with complete conversion of epoxy-triglyceride to esterified triglyceride.

Effect of Catalyst Loading and Temperature

Figure 7:
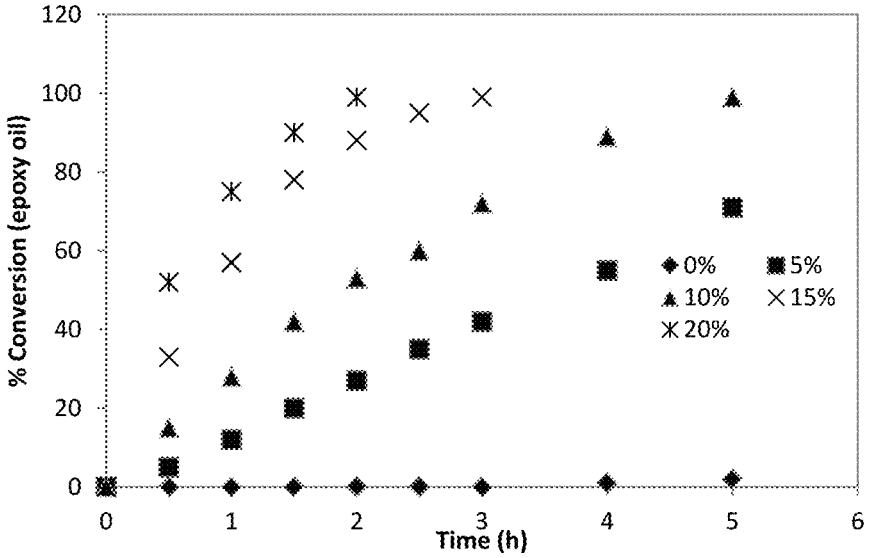
FIG. 7 is a graph showing the effect of catalyst loading on the conversion of epoxy canola oil to esterified canola oil in exemplary embodiments of the application.
Figure 9:
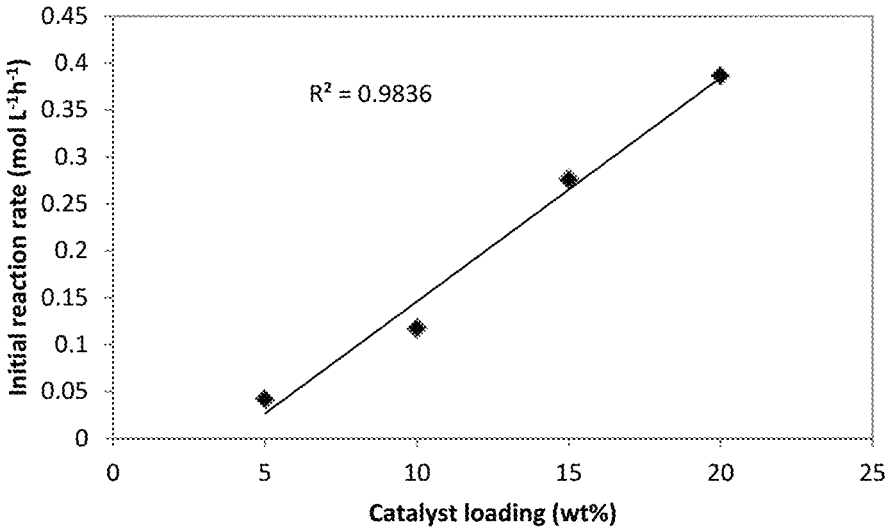
FIG. 9 is a graph showing the relationship between catalyst loading and initial reaction rate in exemplary embodiments of the application

The effect of catalyst loading on the reaction was evaluated by varying the catalyst loading in 5-20 wt % with respect to epoxy canola oil. It was observed that the percentage conversion of epoxy canola oil was increased with catalyst loading (FIG. 7), which was due to the proportional increase in the active site of the catalyst. FIG. 9 shows that the initial rate of the reaction was increased linearly with increase in catalyst loading in the reaction from 5-20 wt %. It was also determined that in the absence of catalyst, the reaction did not proceed. The highest conversion of epoxy canola oil was observed with catalyst loading of 10, 15 and 20 wt %. The reaction with catalyst loading of 15 and 20 wt % was found to be faster as compared to that with 10 wt % of loading. However, in the case of a kinetic study a slow reaction is more preferred over the fast reaction; therefore further studies were carried out with 10 wt % of catalyst loading to obtain the lubricant, with complete conversion of epoxy-triglyceride to esterified triglyceride.

Figure 8:
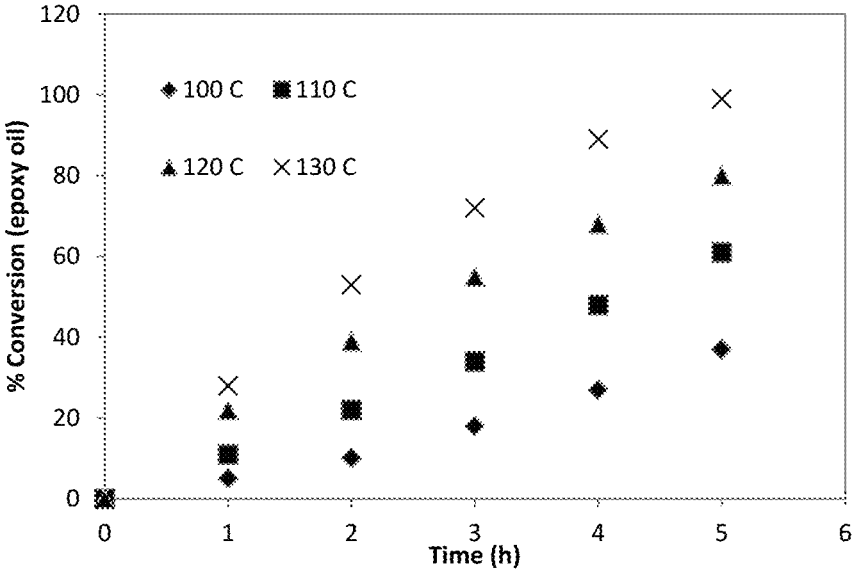
FIG. 8 is a graph showing the effect of temperature on the conversion of epoxy canola oil to esterified canola oil in exemplary embodiments of the application.

The reactions were carried out using sulfated Ti-SBA-15 (10) catalyst with a temperature range of 100-130° C., using a catalyst loading of 10 wt % to investigate its effects on conversion of the epoxy ring opening of canola oil to esterified canola oil. During the experiments the samples were collected periodically, and oxirane content was analyzed to calculate % conversion of epoxy canola oil. It was found that with an increase in the temperature, the conversion of epoxy canola oil was also increased (FIG. 8). The reaction mixture became viscous and dark in appearance at 140° C., which can be due to the polymerization reaction that initiated at the reflux temperature of acetic anhydride. Park et al. (2004, 2005) also determined that epoxy oil is susceptible to polymerization reaction at higher temperatures [35,36]. A 100% conversion of epoxy canola oil to esterified canola oil was obtained at 130° C.; hence, this temperature was chosen for further experiments.

Catalyst Reusability Study

Catalyst reusability can be an important criteria for green and sustainable technology. Sulfated Ti-SBA-15(10) catalyst was reused in up to four runs (Table 4). After each run, catalyst was filtered and refluxed with 100 mL of acetone to remove the reactant and product adsorbed on the catalyst surface. Further, the catalyst was dried at 120±10° C. for 3 h. In a batch reaction, there was an inevitable loss of particles during filtration and handling. Hence, the actual amount of catalyst used in the next batch was almost 5% less than the previous batch. The loss of the catalyst was made up with fresh catalyst. The marginal decrease in the conversion of epoxy canola oil to esterified canola oil was observed after each run. Hence, it can be concluded that the catalyst has good reusability.

Development of Kinetic Model and Reaction Mechanism for the Ring Opening of Epoxy Canola Oil to Esterified Canola Oil The plausible mechanistic pathway of ring opening of epoxy canola oil to esterified canola oil can be predicted by the development of a kinetic model. For this study, reactions were carried out at 100, 110, 120 and 130° C. and samples were analyzed periodically to develop the kinetic model of the reaction (FIG. 8). Eley-Rideal and Langmuir-Hinshelwood-Hougen-Watson (LHHW) type mechanisms were tested, and LHHW type mechanism was found to hold good for ring opening of epoxy canola oil to esterified canola oil. LHHW type mechanism proceeds via involvement of two sites (similar in nature) and the reaction was controlled by 3 steps, viz., adsorption, surface reaction and desorption. It was assumed that epoxy canola oil (ECO) and acetic anhydride (AA) were weakly adsorbed on the catalyst active sites. Adsorption of ECO on vacant site is given by, $$ECO + S \overset{K_1}{\Longleftrightarrow} ECO \cdot S \tag{3}$$

Adsorption of AA on vacant site is given by $$AA + S \overset{K_2}{\Longleftrightarrow} AA \cdot S \tag{4}$$

Surface reaction of ECO and AA form esterified product (EP) on the site.

$$ECO \cdot S + AA \cdot S \overset{K_{SR}}{\Longleftrightarrow} EP \cdot S + S \tag{5}$$

Desorption of esterified product is given by $$EP \cdot S \overset{K'_{EP}}{\Longleftrightarrow} RCO + S \tag{6}$$

Surface reaction is the rate controlling reaction, and then the rate of reaction of ECO is given by $$-r_{ECO} = -\frac{dC_{ECO}}{dt} = K_{SR}C_{ECO \cdot S} \cdot C_{AA \cdot S} - K'_{SR}C_{EP \cdot S} \cdot C_S \tag{7}$$

Value of $C_s$ can be calculated from site balance, $$C_t = C_{ECO} + C_{AA} + C_{EP} + C_S \tag{8}$$

Where $C_t$=Total active sites available.

$$-\frac{dC_{ECO}}{dt} = \frac{k_{SR}C_t^2(K_1K_2C_{ECO} \cdot C_{AA} - (k'_{SR}C_{ECO}/k_{SR}))}{(1 + K_1C_{ECO} + K_2C_{AA} + C_{EP}/K_{EP})^2} \tag{9}$$

When the reaction is far away from equilibrium, $$-\frac{dC_{ECO}}{dt} = \frac{k_r w C_{ECO} \cdot C_{AA}}{(1 + K_1 C_{ECO} + K_2 C_{AA} + C_{EP}/K_{EP})^2} \quad (10)$$

At time (t)=0, $C_{EP}=0$ $$-\frac{dC_{ECO}}{dt} = \frac{k_r w C_{ECO} \cdot C_{AA}}{(1 + K_1 C_{ECO} + K_2 C_{AA})^2} \quad (11)$$

Where $k_r w = k_{SR} K_1 K_2 C_t^2$; w=catalyst wt (g cat/L of liquid phase). If the adsorption constants are very small, then the above equation reduces to $$-\frac{dC_{ECO}}{dt} = k_r w C_{ECO} \cdot C_{AA} \quad (12)$$

A large excess of acetic anhydride was used in the reaction. Therefore, $C_{AA} \cong C_{AA,0}$ can be assumed in this reaction. Hence, the above equation can be written in term of fractional conversion as, $$\frac{dX_{ECO}}{dt} = k'(1 - X_{ECO}) \quad (13)$$

Where $k' = k_r w C_{AA,0}$ (14)

Integrating the above equation, the final expression leads to $$-\ln(1 - X_{ECO}) = K't \quad (15)$$

Figure 10:
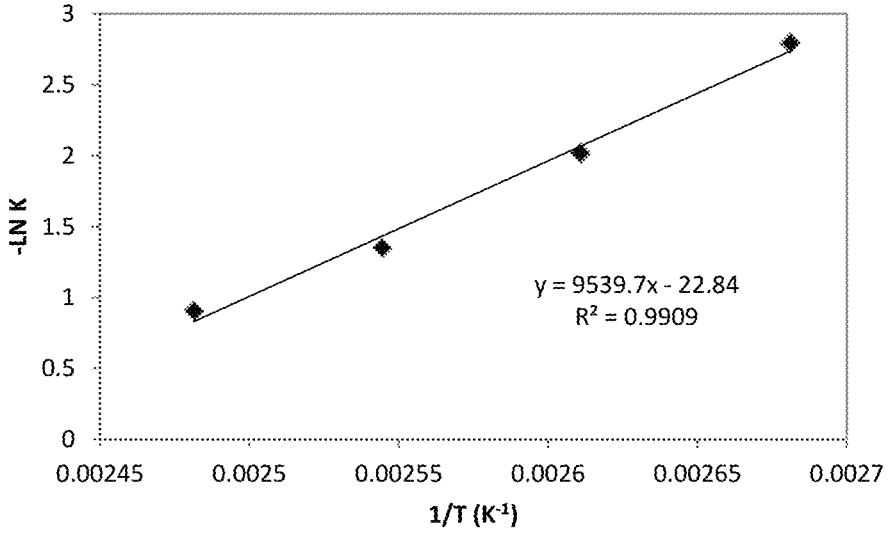
FIG. 10 is an Arrhenius plot (−ln k vs. 1/T) for the conversion of epoxy canola oil to esterified canola oil at different temperatures in exemplary embodiments of the application.

Thus, a plot of $-\ln(1-X_{ECO})$ against time (t) was made for at different temperatures. It resulted in different reaction rate constants at different temperatures (Table 5). From the kinetic model data, it was observed that the reaction rate constant increases with an increase in the temperature, indicating that the reaction is endothermic, and the reaction is a pseudo first order with respect to epoxy canola oil. Arrhenius plot was made by plotting −ln k vs. 1/T (FIG. 10). The value of apparent activation energy of epoxy ring opening of epoxy canola oil to esterified canola oil was found to be 19.0 kcal/mol. This value confirms that the reaction is kinetically controlled.

The exact reaction pathway for ring opening of epoxy canola oil to esterified canola oil by heterogeneous catalyst is not fully understood. However, Laitinen et al. (1998) reported the mechanism of acid catalyzed epoxide ring opening of methyloxirane which is based on Ab initio quantum mechanical and density functional theory calculation [37]. On the basis of above derived LHHW type kinetic model and mechanism reported by Laitinen et al. (1998), the plausible LHHW type reaction mechanism is depicted in FIG. 2. The first step is adsorption, wherein the epoxy canola oil and acetic anhydride are adsorbed on the active sites of the catalyst. The second step is surface reaction, wherein acetic anhydride undergoes a nucleophilic attack by oxygen atom of epoxy ring which resulted in a mono acylated intermediate product and acetate anion. Eventually, the mono acylated intermediate product undergoes a nucleophilic attack by acetate anion to produce diacylated (esterified) product. In the third step, diacylated product is desorbed from the catalyst, and active sites are again regenerated for the next reaction.

Product Isolation, Confirmation and Tribological Properties

The epoxy canola oil underwent simultaneous ring opening and esterification reactions in the presence of acetic anhydride by sulfated Ti-SBA-15(10) catalyst to produce an esterified canola oil (FIG. 1, step-2). The progress of the reaction was monitored by oxirane content value, and after complete conversion of epoxy canola oil to esterified canola oil, 100 mL of ethyl acetate was added to the reaction mixture. Thereafter, the catalyst was filtered from the reaction mixture through filter paper. Then, 100 mL of water was added to the filtrate and stirred for 15 min. Ethyl acetate layer was separated through separating funnel and evaporated on rotary evaporator. Viscous yellow colored oil was obtained. The esterified canola oil was confirmed by FTIR, $^1$HNMR, and $^{13}$CNMR.

Figure 11:
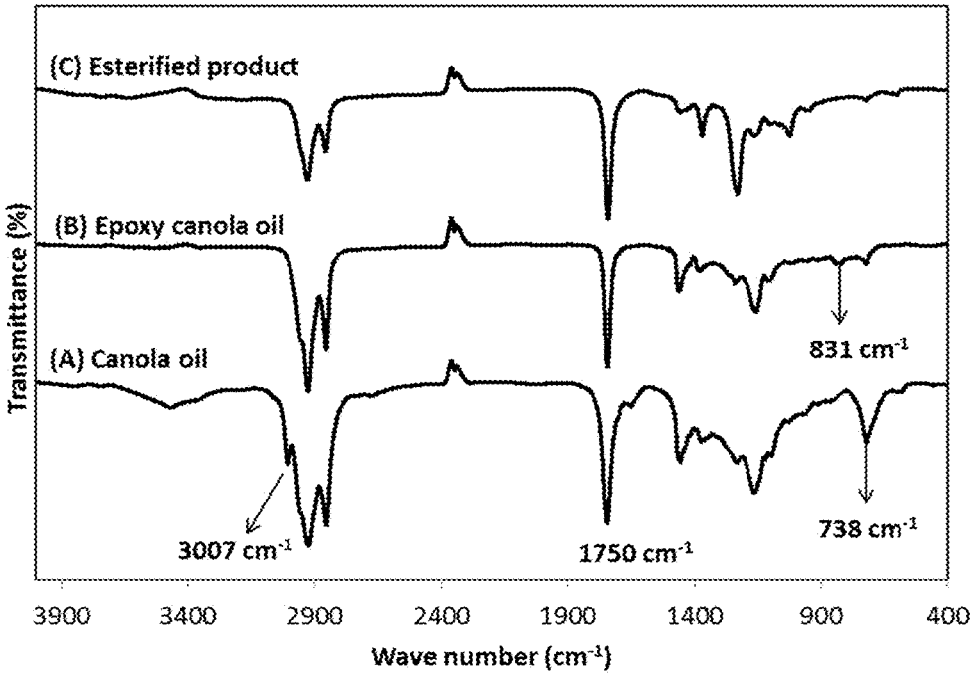
FIG. 11 shows the FTIR spectra of canola oil (A), epoxy canola oil (B), and esterified canola oil (C)
Figure 12:
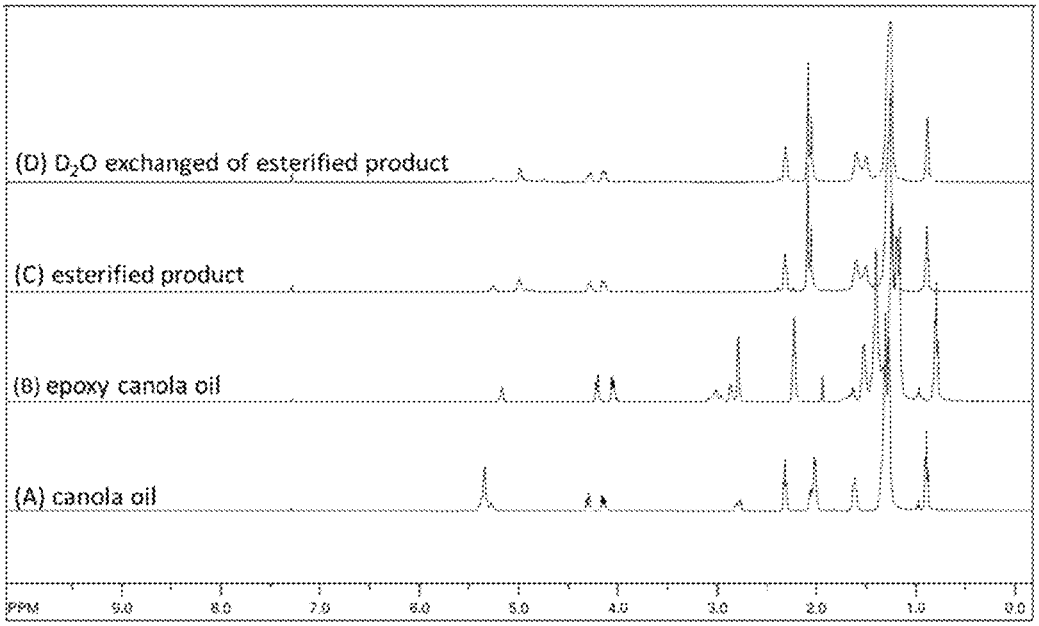
FIG. 12 shows the $^1H$ NMR of canola oil (A), epoxy canola oil (B), esterified canola oil (C) and $D_2O$ exchanged esterified canola oil (D)
Figure 13:
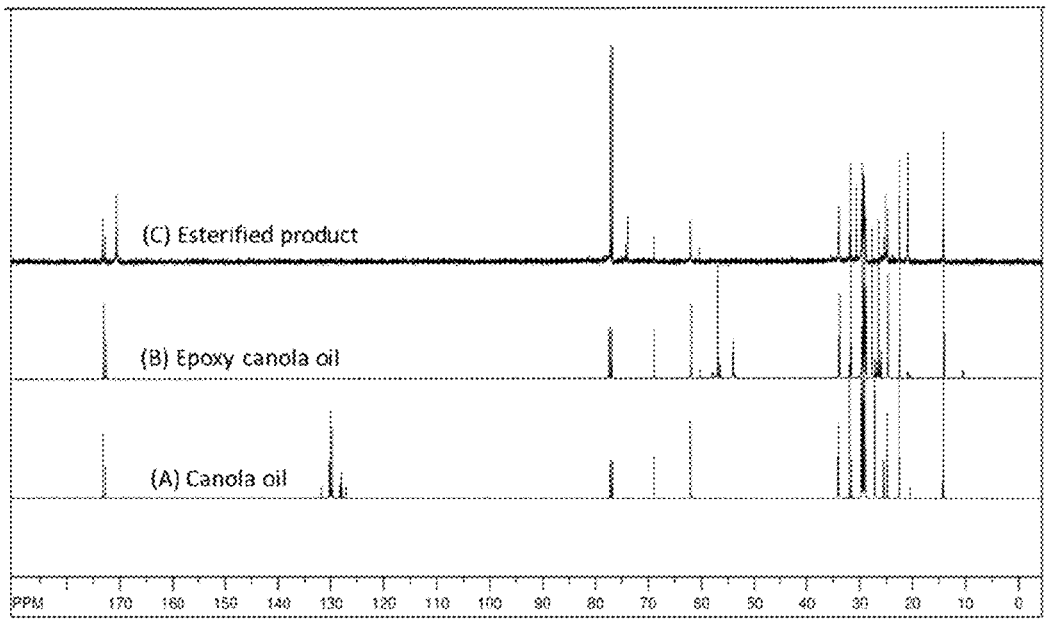
FIG. 13 shows the $^{13}C$NMR spectra of canola oil (A), epoxy canola oil (B) and esterified canola oil (C)

FT-IR spectra of canola oil (A), epoxy canola oil (B), and esterified canola oil (C) are shown in FIG. 11. Canola oil (A) has a characteristic band at 3007 cm$^{-1}$ and 738 cm$^{-1}$ which is attributed to the C—H stretching and C—H bending of C═C—H double bond. The bands at 3007 cm$^{-1}$ and 738 cm$^{-1}$ disappeared after the epoxidation reaction, indicating that almost all —C═C— bonds have been converted into the epoxide. The new band appeared at 831 cm$^{-1}$ which is attributed to the epoxy group of epoxy canola oil and is in accordance with the literature reported by Vlcek and Petrovic (2006) [38]. The FT-IR spectra of the esterified product (C) has no band at 831 cm$^{-1}$ which is characteristic of epoxy group. The intensity of band at 1750 cm$^{-1}$ increased, which confirmed the formation of esterified triglyceride. FIG. 12 represents $^1$H NMR of canola oil (A), epoxy canola oil (B), esterified canola oil (C) and $D_2O$ exchanged esterified product (D). $^1$H NMR spectra of epoxy canola oil (B) show the chemical shift of 2.7-3.1 ppm region, which represents both CH— proton attached to the oxygen atom of epoxy group and it is in accordance with the literature report [20]. $^1$H NMR spectra of esterified canola oil (C) shows the new chemical shift at 5.0 ppm. This represents CH— proton attached to carbonyl group, while the chemical shift present in 2.7-3.1 ppm in epoxy canola oil (B) is not present esterified canola oil (C) confirming the product formation. The $D_2O$ exchanged $^1$H NMR spectra of esterified product (D) confirmed that there is no free hydroxyl group is present in the molecule. The triglyceride backbone is important for maintaining the biodegradability of the vegetable oil [14]. The methane proton of —$CH_2$—CH—$CH_2$— glycerol's backbone was also confirmed by the presence of chemical shift in 5.2-5.4 ppm. FIG. 13 represents the $^{13}$CNMR spectra of canola oil (A), epoxy canola oil (B) and esterified canola oil (C). The $^{13}$CNMR spectra of canola oil (A) shows the signal between 120-140 ppm, which is characteristics of olefinic (—C═C—) carbon atom. The $^{13}$CNMR spectra of epoxy canola oil (B) has no signal between 120-140 ppm, which indicates the complete disappearance of the olefinic carbon (—C═C—) atom. Also, epoxy canola oil (B) shows signals between 53-58 ppm, which is characteristic of the epoxy carbon atom. The $^{13}$CNMR spectrum of esterified product (C) shows no signal between 53-58 ppm, while new signal at 170 ppm is observed; which is due to the presence of carbonyl carbon atom in the molecule. The molecular weight of the esterified product was found to be 1129 by mass spectrum data. Therefore, FT-IR, $^1$HNMR, $^{13}$CNMR, and mass spectrum confirmed the formation of esterified canola oil in the reaction.

Figure 14:
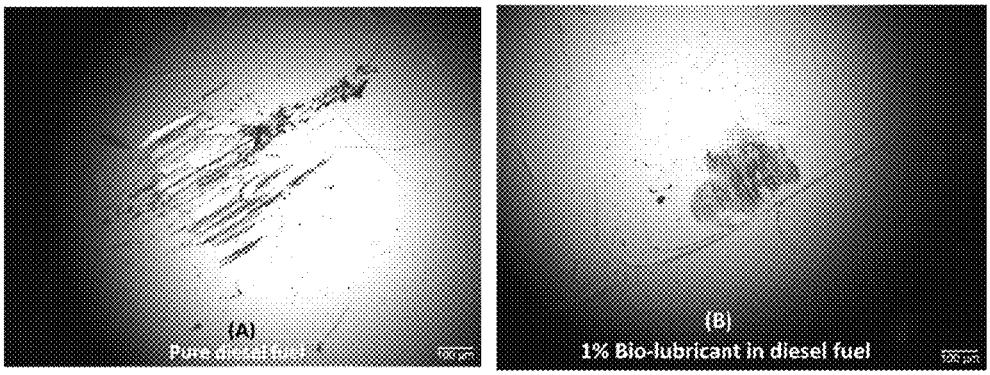
FIG. 14 shows the microscopic images of the wear scar generated on test metal surface in the presence of pure diesel fuel and 1% esterified canola oil blended in the diesel fuel in exemplary embodiments of the application.

The efficiency of a lubricant to lubricate the contact surfaces of metal can depend on the viscosity of the liquid. Esterified canola oil was found to be highly viscous. The viscous nature of the product is the result of epoxidation and esterification, which not only removed the unsaturation but also increased the aliphatic linkage in the oil (FIG. 1). Tribological properties of esterified canola oil are presented in Table 6. The kinematic viscosity of esterified canola oil was measured at 100° C. and was 670 cSt. Oxidative stability is an important property of lubricant because automobile applications are dependent on it. Oxidative stability of canola oil and esterified canola oil was measured, bearing in mind that canola oil has high amount of monounsaturation and polyunsaturation. As a result, the oxidative induction time (OTI) of canola oil and esterified canola oil was found to be 0.6 h and 56.1 h, respectively. The high OIT of esterified canola oil is due to the absence of unsaturation. Cloud point is the temperature at which liquid becomes cloudy in appearance whereas pour point is the lowest temperature at which it loses flow characteristics. Cloud point and pour point values of esterified canola oil was found to be −3 and −9° C., respectively. The lubricating property of liquid is defined as the quality that prevents the wear when two moving parts come into contact with each other [39]. ASTM D6079-04 method was used to evaluate lubricating property of esterified canola oil by using the High-Frequency Reciprocating Rig (HFFR) apparatus. FIG. 14 shows the microscopic images of the wear scar generated on a test metal surface in the presence of pure diesel fuel and 1% esterified canola oil blended in the diesel fuel. Esterified canola oil blended in the diesel fuel resulted in wear scar of 130 μm, while pure diesel fuel resulted in wear scar of 600 μm. Therefore, it can be concluded that esterified canola oil has good lubricating properties and has a future in automobile industries.

CONCLUSIONS

Sulfated Ti-SBA-15(10) was found to be the most active, selective, stable and reusable catalyst as compared to other commercial catalysts such as, Amberlyst-15, IRA-200 and IRA-400. A kinetic model for ring opening of epoxy canola oil to esterified canola oil was developed and it follows the LHHW type mechanism. The oxidative property of esterified canola oil was found to be outstanding due to the absence of unsaturation in molecules. Esterified canola oil also demonstrated excellent lubricity properties. Esterified canola oil is renewable, biodegradable and non-toxic, therefore it can be considered as a replacement for synthetic lubricants.

Nomenclature

ECO=Reactant species—Epoxy canola oil

AA=Reactant species—Acetic anhydride

EP=Product species—Esterified product $D_{ECO}$=Diffusion coefficient ECO in AA ($m^2/s$)

$M_{Aa}$=Molecular weight of acetic anhydride $V_{ECO}$=Molar volume of epoxy canola oil $kc_{ECO}$=Mass transfer co-efficient for epoxy canola oil $W_{ECOr}$=Mass transfer flux $R_P$=Particle radius $D_{eECO}$=Effective diffusivity of epoxy canola oil (θ)=Porosity of the catalyst $K_1$=Equilibrium constant for adsorption of ECO on catalyst surface (L/mol)

$K_2$=Equilibrium constant for adsorption of AA on catalyst surface (L/mol)

$K_{SR}$=Equilibrium constant for surface reaction (L/mol)

$K'_{EP}$=Equilibrium constant for desorption of EP on catalyst surface (mol/L)

$r_{ECO}$=Observed rate of reaction (mol/g cat. h)

$C_t$=Total active sites t=Time (h)

w=Catalyst loading (g.cat/L of liquid phase)

ρ=Density of catalyst particle ($g/cm^3$)

τ=Tortuosity

μ=Viscosity of reaction mixture (kg/m.$)

All publications, patents and patent applications are herein incorporated by reference in their entirety to the same extent as if each individual publication, patent or patent application was specifically and individually indicated to be incorporated by reference in its entirety. Where a term in the present application is found to be defined differently in a document incorporated herein by reference, the definition provided herein is to serve as the definition for the term.

TABLE 1

Textural characterization of Ti-SBA-15 and sulfated Ti-SBA-15 with different Si/Ti ratios (10 to 80).

| Sr. No | Catalyst* | $S_{BET}$ ($m^2/g$) | $d_P$ (nm) | $V_P$ ($cm^3/g$) | EDX elemental analysis (wt %) Si | Ti | O | S |
|---|---|---|---|---|---|---|---|---|
| 1 | Amorphous $SiO_2$ | 1011 | 2.3 | 0.59 | — | — | — | — |
| 2 | SBA-15 | 864 | 6.4 | 1.03 | — | — | — | — |
| 3 | Ti-SBA-15 (10) | 993 | 5.5 | 1.36 | 41.3 | 7.1 | 51.6 | — |
| 4 | Ti-SBA-15 (20) | 989 | 5.4 | 1.36 | 43.9 | 3.7 | 52.4 | — |
| 5 | Ti-SBA-15 (40) | 1030 | 5.3 | 1.38 | 45.3 | 1.9 | 52.8 | — |
| 6 | Ti-SBA-15 (80) | 1066 | 5.5 | 1.49 | 46.1 | 1.0 | 52.9 | — |
| 7 | Sulfated Ti-SBA-15 (10) | 594 | 6.6 | 0.99 | 39.3 | 6.3 | 52.3 | 2.1 |

$S_{BET}$: specific surface area calculated by the BET method, Vp: pore volume determined by nitrogen adsorption at a relative pressure of 0.98, dp: mesopore diameter corresponding to the maximum of the pore size distribution obtained from the adsorption isotherm by the BJH method.

*The number in parenthesis denotes Si/Ti ratio in the sample.

TABLE 2

Effect of various catalysts on % conversion of epoxy canola oil to esterified product

| Sr. No. | Catalysts | Conversion (%) |
|---|---|---|
| 1 | Amorphous $SiO_2$ | 5 |
| 2 | SBA-15 | 7 |
| 3 | Ti-SBA-15 (80) | 11 |
| 4 | Ti-SBA-15 (40) | 19 |
| 5 | Ti-SBA-15 (20) | 26 |
| 6 | Ti-SBA-15 (10) | 32 |
| 7 | Sulfated Ti-SBA-15 (10) | 100 |
| 8 | Amberlyst-15 | 55 |
| 9 | IRA-400 | 24 |
| 10 | IRA-200 | 19 |

Reaction conditions: Epoxidized canola oil (3.0 g), acetic anhydride (4.5 g), catalyst (10 wt % w.r.t. epoxy canola oil) agitation speed (1000 rpm), temperature (120° C.), time (8 h).

TABLE 3

Effect of speed of agitation on % conversion of epoxy canola oil to esterified product using sulfated Ti-SBA-15(10) catalyst

| Speed of agitation (rpm) | Conversion (%) |
|---|---|
| 600 | 85 |
| 800 | 92 |
| 1000 | 100 |
| 1200 | 100 |

Reaction conditions: Epoxidized canola oil (3.0 g), acetic anhydride (4.5 g), catalyst (10 wt % w.r.t. epoxy canola oil), temperature (130° C.), time (5 h).

TABLE 4

Reusability study of sulfated Ti-SBA-15 (10) catalyst on % conversion of epoxy canola oil to esterified product

| Catalyst run | Conversion (%) |
|---|---|
| $1^{st}$ | 99 |
| $2^{nd}$ | 96 |
| $3^{rd}$ | 92 |
| $4^{th}$ | 87 |

Reaction conditions: Epoxidized canola oil (3.0 g), acetic anhydride (4.5 g), catalyst (10 wt % w.r.t. epoxy canola oil), agitation speed (100 rpm), temperature (130° C.), time (5 h).

TABLE 5

Rate constant (k) for ring opening of epoxy canola oil to esterified product using sulfated Ti-SBA-15 (10) at different temperatures

| Sr. No. | Temperature (° C.) | T (Kelvin) | rate constant k, ($min^{-1}$) | 1/T ($Kelvin^{-1}$) | ln k |
|---|---|---|---|---|---|
| 1 | 100 | 373 | 0.0612 | 0.002681 | −2.793 |
| 2 | 110 | 383 | 0.1329 | 0.002611 | −2.018 |
| 3 | 120 | 393 | 0.2595 | 0.002545 | −1.348 |
| 4 | 130 | 403 | 0.4041 | 0.002481 | −0.906 |

TABLE 6

Tribological properties of esterified product (bio-lubricant)

| Sr. no. | Tribological property | bio-lubricant |
|---|---|---|
| 1 | Viscosity at 100° C. (cSt) | 670 |
| 2 | Cloud point (° C.) | −3 |
| 3 | Pour point (° C.) | −9 |
| 4 | Oxidative induction time (h) | 56.1 |
| 5 | Wear scar diameter (μm) | 130 |

FULL CITATIONS FOR DOCUMENTS REFERRED TO IN THE APPLICATION

[1] A. Adhvaryu, Z. S. Liu, S. Z. Erhan, Industrial Crops and Products 21 (2005) 113-119.

[2] A. Birova, A. Pavloviova, J. Cvengro, Journal of Synthetic Lubrication 18 (2002) 291.

[3] Y. M. Shashidhara, S. R. Jayaram, Tribology International 43 (2010) 1073-1081.

[4] A. Campanella, E. Rustoy, A. Baldessari, M. A. Baltanás, Bioresource Technology 101 (2010) 245-254.

[5] R. Becker, A. Knorr, Lubrication Science 8 (1996) 95-117.

[6] H. S. Hwang, S. Z. Erhan, Journal of American Oil Chemists' Society 78 (2001) 1179-1184.

[7] L. E. Johansson, S. T. Lundin, Journal of American Oil Chemists' Society 56 (1979) 974-980.

[8] S. Sinadinovic-Fiser, M. Jankovic, Z. S. Petrovic, Journal of American Oil Chemists' Society 78 (2001) 725-731.

[9] A. Adhvaryu, S. Z. Erhan, Industrial Crops and Products 15 (2002), 247-254.

[10] L. A. Rios, P. P. Weckes, H. Schuster, W. F. Hoelderich, Applied Catalysis A: General 284 (2005) 155-161.

[11] Z. S. Petrovic, A. Zlatanic, C. C. Lava, S. Sindinovic-Fiser, European Journal of Lipid Science and Technology 104 (2002) 293-299.

[12] G. D. Yadav, I. V. Borkar, American Institute of Chemical Engineers Journal 52 (2006) 1235-1247.

[13] C. Orellana-Coca, U. Toernvall, D. Adlercreutz, B. Mattiasson, R. Hatti-Kaul, Biocatalysis and Biotransformation 23 (2005) 431-437.

[14] P. S. Lathi, B. Mattiasson, Applied Catalysis B: Environmental 69 (2006) 207-212.

[15] V. V. Goud, A. V. Patwardhan, N. C. Pradhan, *Bioresource Technology* 97 (2006) 1365-1371.

[16] S. Dinda, A. V. Patwardhan, V. V. Goud, N. C. Pradhan, *Bioresource Technology* 99 (2008) 3737-3744.

[17] H. Lu, S. Sun, Y. Bi, G. Yang, R. Ma, H. Yang, European Journal of Lipid Science and Technology 112 (2010) 1101-1105.

[18] U. Tornvall, C. Orellana-Coca, R. Hatti-Kaul, D. Adlercreutz, Enzyme and Microbial Technology 40 (2007) 447-451.

[19] P. D. Meshram, R. G. Puri, H. V. Patil, International Journal of ChemTech Research 3 (2011) 1152-1163.

[20] R. Mungroo, N. C. Pradhan, V. V. Goud, A. K. Dalai, Journal of American Oil Chemists' Society 85 (2008) 887-896.

[21] J. Salimon, N. Salih, E. Yousif, European Journal of Lipid Science and Technology 112 (2010) 519-530.

[22] A. Z. Fadhel, P. Pollet, C. L. Liotta, C. A. Eckert, Molecules 15 (2010) 8400-8424.

[23] R. V. Sharma, K. K. Soni, A. K. Dalai, Catalysis Communications 29 (2012) 87-91.

[24] T. Jiang, Q. Zhao, M. Li, H. Yin, Journal of Hazardous Materials 159 (2008) 204-209.

[25] L. Afanador, S. Ortega, R. Gómez, M. E. Nino-Gomez, Fuel 100 (2012) 43-47.

[26] G. A. Eimer, S. G. Casuscelli, G. E. Ghione, M. E. Crivello, E. R. Herrero, Applied Catalysis A: General 298 (2006) 232-242.

[27] F. Berube, B. Nohair, F. Kleitz, S. Kaliaguine, Chemistry of Materials 22 (2010) 1988-2000.

[28] S. K. Das, M. K. Bhunia, A. Bhaumik, Journal of Solid State Chemistry 183 (2010) 1326-1333.

[29] K. K. Soni, K. Chandra Mouli, A. K. Dalai, J. Adjaye, Microporous Mesoporous Materials 152 (2012) 224-234.

[30] S. Y. Chen, L. Y. Jang, S. Cheng, Chemistry of Materials 16 (2004) 4174-4180.

[31] G. D. Yadav, P. A. Chandan, N. Gopalaswami, Clean Technologies and Environmental Policy 14 (2012) 85-95.

[32] H. S. Fogler, Elements of Chemical Reaction Engineering (4th ed.) Prentice Hall, Massachusetts, 2006, pp. 832-833, 839-841.

[33] D. S. Martini, B. A. Braga, D. Samios, Polymer 50 (2009) 2919-2925.

[34] E. A. Dejaegere, J. W. Thybaut, G. B. Marin, G. V. Baron, J. F. M. Denayer, Industrial and Engineering Chemistry Research 50 (2011) 11822-11832.

[35] S. J. Park, F. L. Jin, J. R. Lee, Macromolcular Rapid Communications 25 (2004) 724-727.

[36] S. J. Park, F. L. Jin, J. R. Lee, J. S. Shin, European Polymer Journal 41 (2005) 231-237.

[37] T. Laitinen, J. Rouvinen, M. Perakyla, Journal of Organic Chemistry 63 (1998) 8157-8162.

[38] T. Vlcek, Z. S. Petrovic, Journal of American Oil Chemists' Society 83 (2006) 247-252.

[39] L. Schumacher, The biodiesel handbook. AOCS Press, Champaign, Ill., 2005, pp 137-144.

We claim:

1. A process for producing a lubricant from an epoxy-triglyceride, the process comprising:

a) treating the epoxy-triglyceride with an esterifying agent in the presence of a heterogeneous catalyst under conditions to produce the lubricant, wherein the heterogeneous catalyst comprises a titanium-substituted silica catalyst.

2. The process of claim 1, wherein the esterifying agent comprises a $C_1$ to $C_6$ alkyl acid anhydride.

3. The process of claim 1, wherein the esterifying agent comprises a carboxylic acid.

4. The process of claim 1, wherein the esterifying agent comprises a carboxylic acid selected from the group consisting of acetic acid, succinic acid, maleic acid, and glutaric acid.

5. The process of claim 2, wherein the esterifying agent comprises acetic anhydride.

6. The process of claim 5, wherein the acetic anhydride is used at about 1.5 wt % to about 4 wt % of the epoxy triglyceride.

7. The process of claim 1, wherein the titanium-substituted silica catalyst has an Si/Ti ratio of at most about 80.

8. The process of claim 1, wherein the heterogeneous catalyst comprises a sulfated titanium-substituted silica catalyst.

9. The process of claim 1, wherein the heterogeneous catalyst comprises sulfated Ti-SBA-15.

10. The process of claim 9, wherein the sulfated Ti-SBA-15 has a Si/Ti ratio of about 10.

11. The process of claim 1, wherein the heterogeneous catalyst comprises at least one of Ti-SBA-15 and sulfated Ti-SBA-15.

12. The process of claim 1, wherein about 5% to about 20% catalyst is present by weight with respect to a weight of the epoxy-triglyceride.

13. The process of claim 1, further comprising filtering a product of a) to recover the heterogeneous catalyst.

14. The process of claim 1, further comprising agitating the epoxy-triglyceride, esterifying agent, and heterogeneous catalyst at a speed of at least about 600 rpm.

15. The process of claim 1, further comprising agitating the epoxy-triglyceride, esterifying agent, and heterogeneous catalyst at a speed of at least about 1000 rpm.

16. The process of claim 1, further comprising carrying out a) at a reaction temperature of about 100 degrees Celsius to about 140 degrees Celsius.

17. The process of claim 1, further comprising carrying out a) at a reaction temperature of about 128 degrees Celsius to about 132 degrees Celsius.

* * * * *